United States Patent [19]

Lu

[11] Patent Number: 4,592,178

[45] Date of Patent: Jun. 3, 1986

[54] GROUND ANCHOR

[76] Inventor: Hsi H. Lu, 2-6, Alley 17, Lane 76, Ho-Ping East Rd., Sec. 2, Taipei, Taiwan

[21] Appl. No.: 721,369

[22] Filed: Apr. 9, 1985

[51] Int. Cl.[4] ..... E02D 5/44

[52] U.S. Cl. ..... 52/155; 52/162; 52/163; 52/166; 166/272; 166/273; 405/248; 405/260

[58] Field of Search ..... 52/155, 156, 160, 161, 52/162, 163, 164, 165, 166; 405/248, 259, 260; 175/320; 166/202, 272, 273, 284

[56] References Cited

U.S. PATENT DOCUMENTS

| | | | |
|---|---|---|---|
| 631,131 | 8/1899 | Sharrock | 52/162 |
| 720,255 | 2/1903 | Clum | 52/162 |
| 912,018 | 2/1909 | McNutt | 52/164 |
| 2,340,447 | 2/1944 | Aiken | 52/162 |
| 2,703,544 | 3/1955 | Ewing et al. | 52/162 |
| 2,771,746 | 11/1956 | Fischer et al. | 52/162 |
| 2,959,193 | 11/1960 | Guldenzoph et al. | 175/320 X |
| 3,623,550 | 11/1971 | Lajarte | 166/202 X |
| 3,891,034 | 6/1975 | Owen et al. | 166/202 X |
| 3,935,912 | 2/1976 | Shibata | 52/163 X |
| 3,972,198 | 8/1976 | Maly et al. | 405/248 X |
| 4,015,433 | 4/1977 | Shibata | 52/160 X |
| 4,023,314 | 5/1977 | Tanner | 52/162 X |
| 4,251,963 | 2/1981 | Patterson | 52/162 X |
| 4,310,059 | 1/1982 | Moore | 175/320 |
| 4,369,003 | 1/1983 | Brandstetter | 405/260 |
| 4,491,178 | 1/1985 | Terrell et al. | 166/202 |

FOREIGN PATENT DOCUMENTS

| | | | |
|---|---|---|---|
| 1573625 | 8/1980 | United Kingdom | 405/248 |
| 199056 | 7/1967 | U.S.S.R. | 166/202 |

*Primary Examiner*—Donald G. Kelly
*Assistant Examiner*—Richard E. Chilcot, Jr.

[57] ABSTRACT

This invention relates to an improved ground anchor. It comprises a drill bit, an anchor head to which a plurality of swingable arms are pivoted, a double thread nut, a connecting rod with an enlarged rear end, and a socket from which a plurality of steel rods extend rearwardly. It greatly facilitates the work of ground anchorage of a surface structure.

4 Claims, 4 Drawing Figures

GROUND ANCHOR

This application relates to an improved ground anchor to facilitate the drive-in of the ground anchor. The prototype of the ground anchor was applied for patent in the United States, on Nov. 10, 1983, bearing Ser. No. 550,312, now still pending. According to the prototype, a pile with an anchor is provided. The ground anchor is driven into a depth and slighly pulled backward so that its swingable arms stretch out and anchors themself in the ground. The anchor is fixed to the anterior end of the pile. The pile is substantially a hollow elongate tube. The bore inside the tube provide a path to pump water into the ground to wash away the soil in the vicinity of the arms to facilitate further drive-in of the anchor. This invention is an improvement of the prototype.

In use of the ground anchor according to this invention, a front section including the anchor must first be driven into the ground to a depth until the driving force can no longer be transmitted to the front section. Then a first connecting unit is connected to the rear end of the front section. This makes it possible to drive the anchor to a greater depth. And then further connecting units may be added and the procedure is repeated until the anchor is driven to the desired depth. This invention mainly consists in the improvement of the front section.

This invention will be better understood when read in connection with the accompanying drawing in which:

DETAILED DESCRIPTION OF PREFERRED EMBODIMENT

Figure 1:
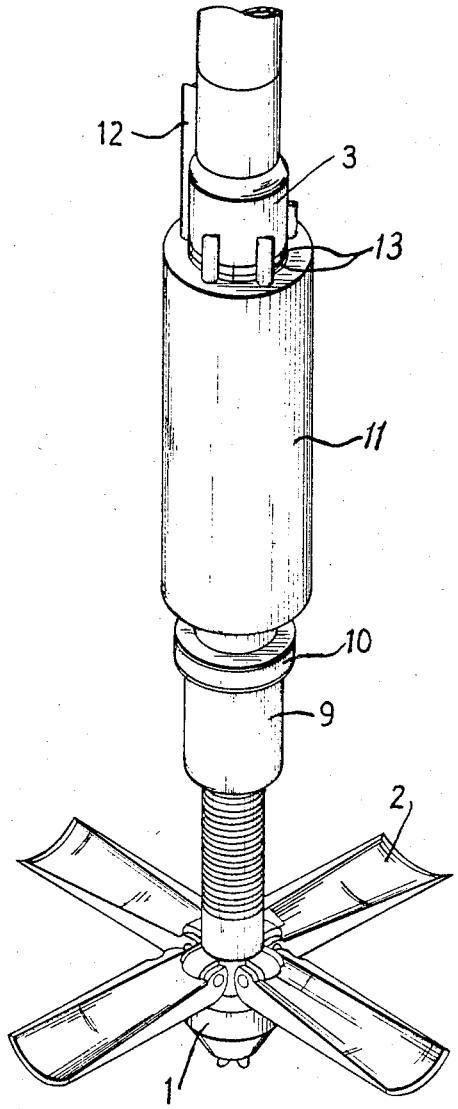
FIG. 1 is a perspective view of this invention.
Figure 2:
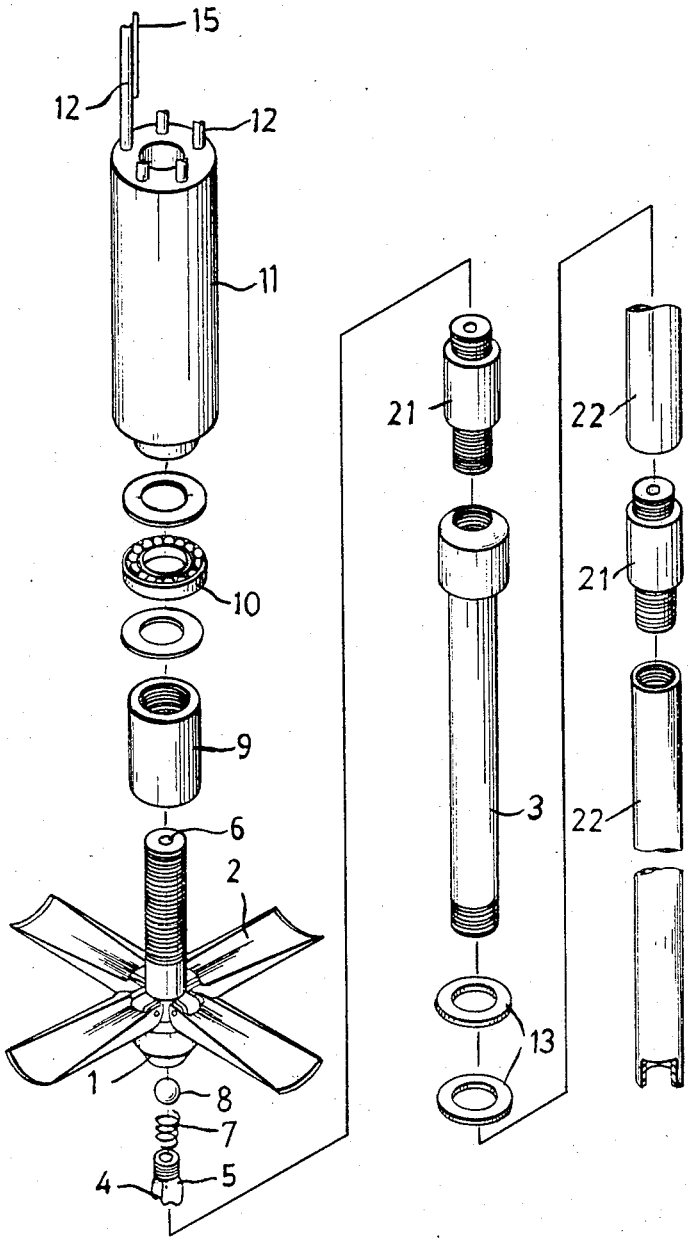
FIG. 2 is a fragmentary view of this invention.
Figure 3:
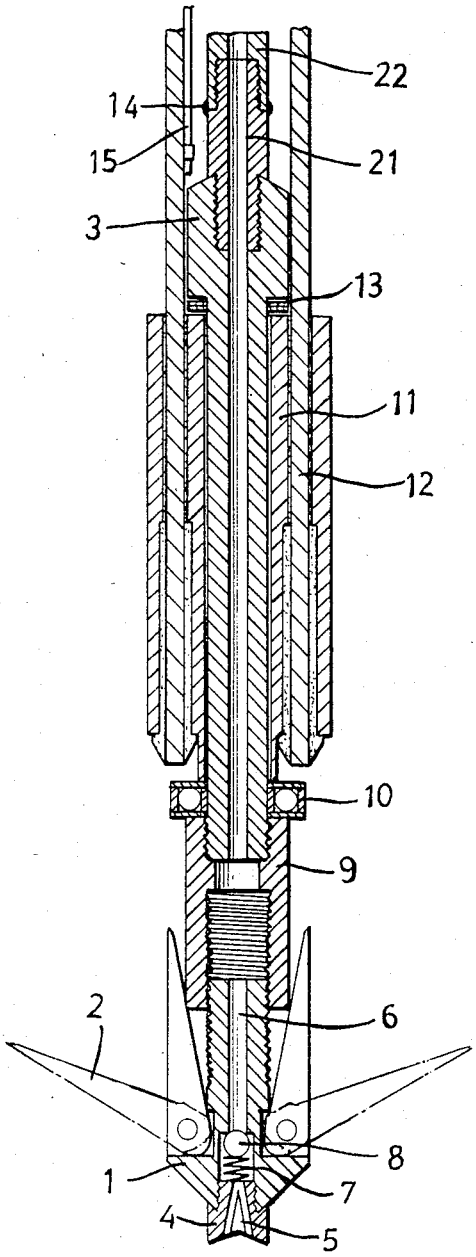
FIG. 3 is a longitudinal section of this invention.
Figure 4:
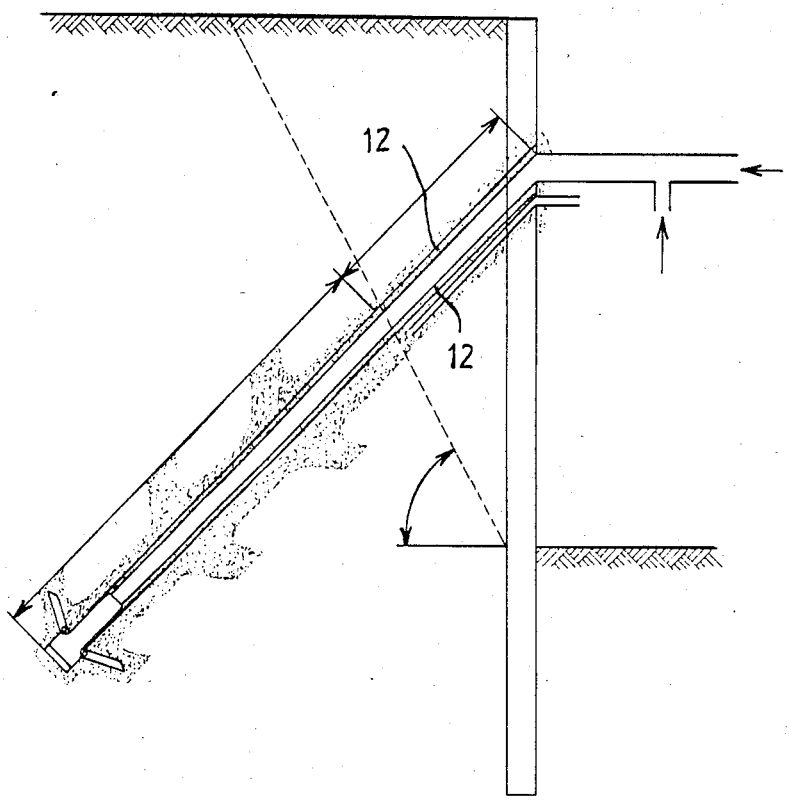
FIG. 4 is an embodiment of this invention.

With reference to the drawing, the aforesaid front section according to this invention mainly comprises an anchor head (1), an plurality of outwardly swingable arms (2), a hollow rod (3), a double threaded nut (9), a thrust bearing (10), and a socket (11). At the tip end of the anchor head (1) there is provided a drill bit (4). The drill bit is provided with a water outlet (5). The front end of the anchor head (1) is internally provided with internal thread to engage with the drill bit (4), whereas its rear end is externally threaded to engage with the nut (9). The rear end of the nut (9) is in connetion with the anterior end of the rod (3). a ball bearing (10) is received at the anterior end of the rod (3). The rear portion of the rod (3) is enlarged, and majority of the remaining portion of smaller diameter is nested in a socket (11). Between the enlarged portion of the rod (3) and the socket (11) there are two washers (13). These elements are all formed by steel material. The socket (11) is provided with a plurality of bores extending along its wall, in each of which there is a steel rod (12). The steel rods are welded and thus fixed in the bores. These rods can be prestressed so that a pulling force can be exerted by these rods to the finished aboveground structure.

In operation, the front section comprising these elements is driven into the ground by conventional means to a depth until the power transmission can no longer reach it. Then a connecting unit is connected to the rear end of the rod (3). Preferably each connecting unit comprises a connector (21), which is externally threaded at both ends, and a connecting tube (22), which is internally threaded at both ends. A plurality of such units may be added until the desired anchoring depth is reached. The front section, together with the following series of connecting units, make an entire pile. Because of the hollow elements, a channel is defined in the pipe, and water can be introduced from the rear end of the pipe to the anchor to wash away the soil to facilitate the drilling. Upstream of the water outlet (5) there is provided a spring-loaded ball (8), biased by a spring (7) to serve as a check valve of the water path to guard the anchor against backflow of the water pumped into the ground. A water pipe (15) is provided beside one of the steel rods (12). The pipe (15) extends from the rod (3) to the above ground position. It is not an indispensible element, but it can help remove the soil. The connector (21) and connecting tube (22) can be welded together to avoid the loosening of their joint. Reference numeral (14) refers to the welding seam. The length of the steel rods corresponds to the drive-in depth of the anchor. After the anchorage of the above ground structure is finished, if it is desired, the connecting units can be removed, leaving but the steel rods (12) (which may be pre-stressed) in the ground, so that the above-ground structure is firmly anchored. The bearing (10) can facilitate the rod (13) to be screwed into the nut (9) without causing undesired corotation of the latter.

I claim:

1. A ground anchor means for anchoring an above-ground structure, comprising a front section with an anchor at its front end, and a plurality of like connecting units connected in series behind said front section, said front section and said connecting units being centrally hollow to define a channel from the rear end of the rearmost connecting unit to the front end of said front section, said front section comprising drilling means at its tip end, and a plurality of arms, one end of each said arm is pivoted to a definite spot of said front section so as to be able to swing with a range of no more than 90 degrees between a first position where each said arm lies substantially parallel to the axial direction of said front section with its free end pointing to the rear end of the rearmost connecting unit, and a second position where each said arm extends outwardly and radially and intersect with the central axis of said front section at an angle no more than 90 degrees, characterized in that said front section comprises elements arranged in series including a first element, of which the front end defines a drill bit and has an outlet for said channel, a second element to which said arms are pivotally mounted, the front end of said second element being engageable with the rear end of said first element, a third element, in form of a double-thread nut, with its both ends internally threaded and its front end being engageable with the rear end of said second element, a fourth element with its front end engageable with the rear end of said third element and its rear end having an enlarged outer diameter, a fifth element in form of a socket encircling the majority of the length of the fourth element, said fifth element being provided with a plurality of rods extending axially and rearwardly to the rear end of the rearmost connecting unit.

2. The ground anchor means according to claim 1, further comprising bearing means disposed at the entrance of the rear end of said third element to avoid the corrotation of said third and fourth elements when the latter is screwed into the former.

3. The ground anchor means according to claim 1, wherein the interior of said first and second means is structured and provided with means to allow a fluid to flow only in the direction toward the outlet of said first element.

4. The ground anchor means according to claim 1, further comprising a water pipe extending from the rear end of the rearmost connecting unit to the rear end and outside of said fourth element.

* * * * *